US005730667A

United States Patent [19]

Jones

[11] Patent Number: 5,730,667

[45] Date of Patent: Mar. 24, 1998

[54] LOCKING BASKETBALL GOAL

[76] Inventor: George B. Jones, Rte. 15, Box 125c, Fayetteville, N.C. 28303

[21] Appl. No.: 313,341

[22] Filed: Sep. 27, 1994

[51] Int. Cl.[6] ..... A63B 63/08

[52] U.S. Cl. ..... 473/447; 473/479

[58] Field of Search ..... 273/1.5 R, 1.5 A; 411/330

[56] References Cited

U.S. PATENT DOCUMENTS

| | | | |
|---|---|---|---|
| 1,062,507 | 5/1913 | Sanders | 273/1.5 R |
| 1,157,333 | 10/1915 | Snell | 273/1.5 R |
| 1,516,859 | 11/1924 | Lantrip | 273/1.5 R |
| 2,596,543 | 5/1952 | Fox | 273/1.5 R |
| 3,534,956 | 10/1970 | Myers | 273/1.5 R |
| 3,603,588 | 9/1971 | Ebstein | 273/1.5 R |
| 3,820,784 | 6/1974 | Boitano et al. | 273/1.5 R |
| 4,834,369 | 5/1989 | Walsh | 273/1.5 R |
| 4,921,248 | 5/1990 | Rapp | 273/1.5 R |
| 4,946,163 | 8/1990 | Aakre et al. | 273/1.5 R |
| 5,022,649 | 6/1991 | Traub | 273/1.5 R |
| 5,149,086 | 9/1992 | Ziff | 273/1.5 R |
| 5,374,055 | 12/1994 | Tung | 273/1.5 R |

*Primary Examiner*—V. Millin
*Assistant Examiner*—Charles W. Anderson

[57] ABSTRACT

A basketball goal is movable from a position wherein ball may be played to an out-of-play position wherein the ball may not be played. A locking mechanism, operable from the ground, maintains the goal in either the play or out-of-play positions.

7 Claims, 6 Drawing Sheets

LOCKING BASKETBALL GOAL

FIELD OF THE INVENTION

This invention relates generally to the field of sports goals and more particularly to basketball goals that are movable between a first position wherein the hoop is substantially perpendicular to the backboard and a second position wherein the hoop is substantially parallel to the backboard. The hoop may be locked in either position to facilitate play or to prevent play.

BACKGROUND OF THE INVENTION

Basketball is a popular sport in the United States and in many foreign countries. In the sport of basketball, a hoop is attached to a backboard, the object being to evade the opposing team's defense and to pass the ball through the opponent's hoop in order to score a goal. It is standard practice to permanently mount the hoop to the goal. The foregoing permits play to occur at all times when the court is accessible. In recent years, it has become more important to limit the use of the basketball court to times when supervision is present. For example, youths will often climb high fences or damage a fence to gain access to a locked basketball court. During unsupervised play, youths can also cause injury to themselves or can damage or otherwise vandalize the court. This results in court down time, injury to persons and property and unnecessary litigation.

As a result of the foregoing, various removable basketball goals have been conceived. For example U.S. Pat. No. 4,921,248 to Rapp discloses a basketball rim which is removable, but it requires the entire rim assembly to be mounted on a pole and then positioned in a narrow slot on the backboard. Once the rim assembly is mounted within the slot, a locking mechanism must be actuated, also with the pole. This concept has not been widely adopted. U.S. Pat. No. 5,022,649 to Traub et al. discloses a quick change hoop assembly. In order to change or remove the hoop, the use of a step ladder is required. The requirement that a relatively tall step ladder be employed in order to mount/remove the hoop has also resulted in the foregoing concept not being widely adopted.

It is therefore an object of the present invention to provide an improved basketball hoop assembly.

Another object of the present invention is to provide a basketball hoop assembly that effectively limits the use of the basketball court.

Still another object of the present invention is to provide a basketball hoop assembly in which use of the court for the play of basketball can be controlled without the necessity of having to remove the goal assembly.

Yet another object of the present invention is to provide a basketball hoop assembly in which the use of the court for the play of basketball can be controlled by an individual from the ground.

A further object of the present invention is to provide a basketball hoop assembly which effectively controls the use of the court and which is relatively inexpensive.

A still further object of the present invention is to provide a basketball hoop assembly which is relatively easy to manufacture, reliable and requires little maintenance.

SUMMARY OF THE INVENTION

The benefits and advantages of the present invention are achieved in a basketball rim assembly for use in mounting a hoop to a basketball backboard. The apparatus comprises a base member adapted to be connected to a basketball backboard. A rim support member has opposing ends and one of the ends is pivotally connected to the base member and the opposite end is adapted to mount the basketball hoop. The rim support member is movable from a first position wherein the rim is positioned for ball play to a second out-of-play position wherein the rim is positioned so that ball cannot be played. Thus, the hoop may be moved between the play and out-of-play positions.

The basketball rim assembly also includes a lock for maintaining the rim support member in either the play position or the out-of-play position. The lock is operatively associated with the rim support member and the base member. A key is adapted to cooperate with the lock for releasing the rim support member from either the play or out-of-play position. The key is mounted on a rim positioning tool which comprises an elongate shaft having a proximal end and a distal end and wherein the proximal end is adapted to be gripped by a user. The key is mounted on the distal end. The rim positioning tool further includes a positioning arm connected to the distal end and extends outwardly therefrom for moving the rim support member between the play and out-of-play positions once the rim is unlocked.

BRIEF DESCRIPTION OF THE DRAWINGS

Some of the features and advantages of the invention having been briefly stated, others will appear from the detailed description which follows, when taken in connection with the accompanying drawings, in which.

DETAILED DESCRIPTION OF THE ILLUSTRATED EMBODIMENTS

While the present invention will be described more fully hereinafter with reference to the accompanying drawings, in which a particular embodiment is shown, it is to be understood at the outset that persons skilled in the art may modify the invention herein described while still achieving the favorable results of this invention. Accordingly, the description which follows is to be understood as a broad teaching disclosure directed to persons of skill in the appropriate arts and not as limiting upon the present invention.

Figure 1:
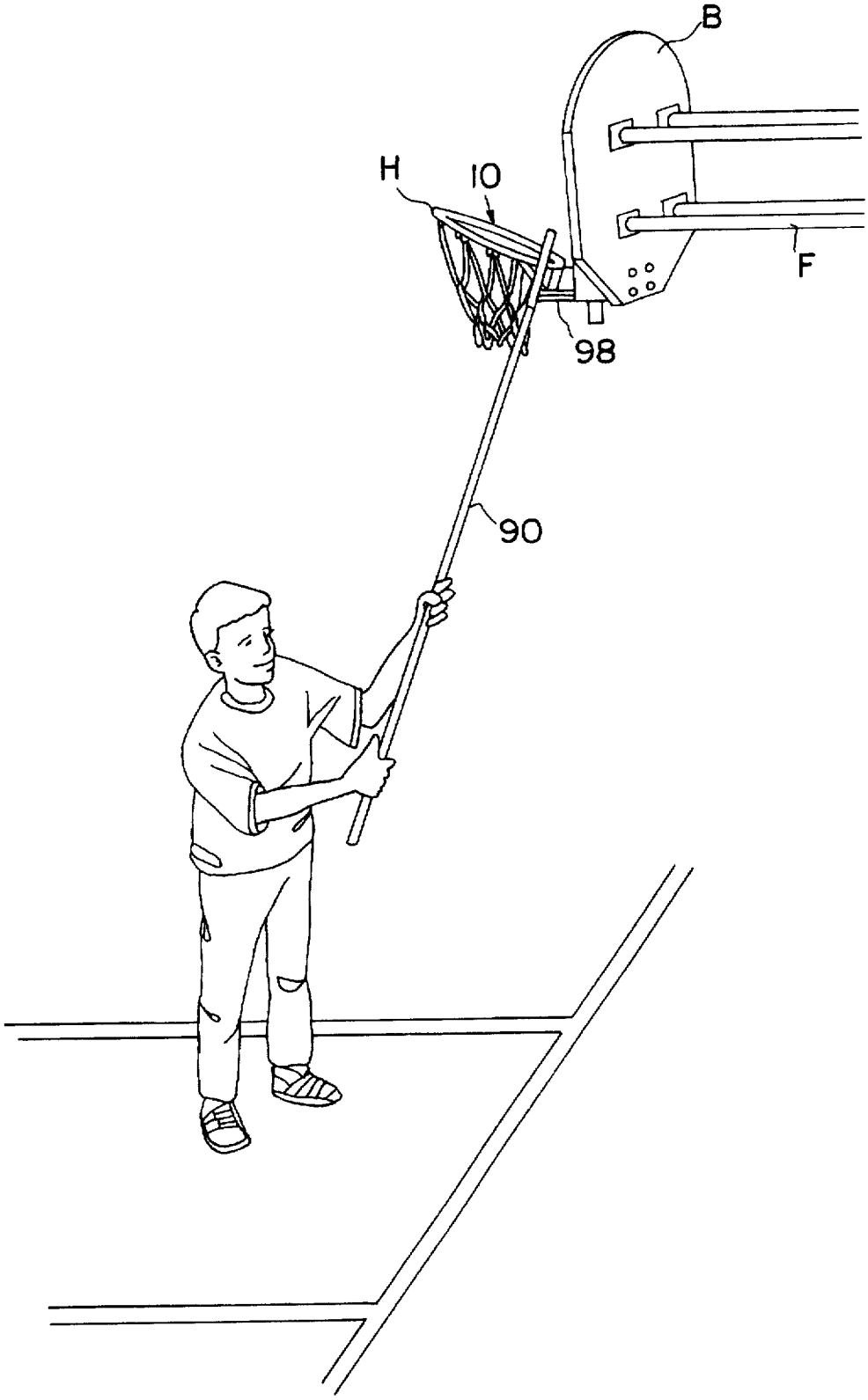
FIG. 1 is a perspective view of basketball rim assembly according to the present invention mounted to a basketball backboard and with an operator unlocking the hoop assembly for movement between the play and out-of-play positions.
Figure 2:
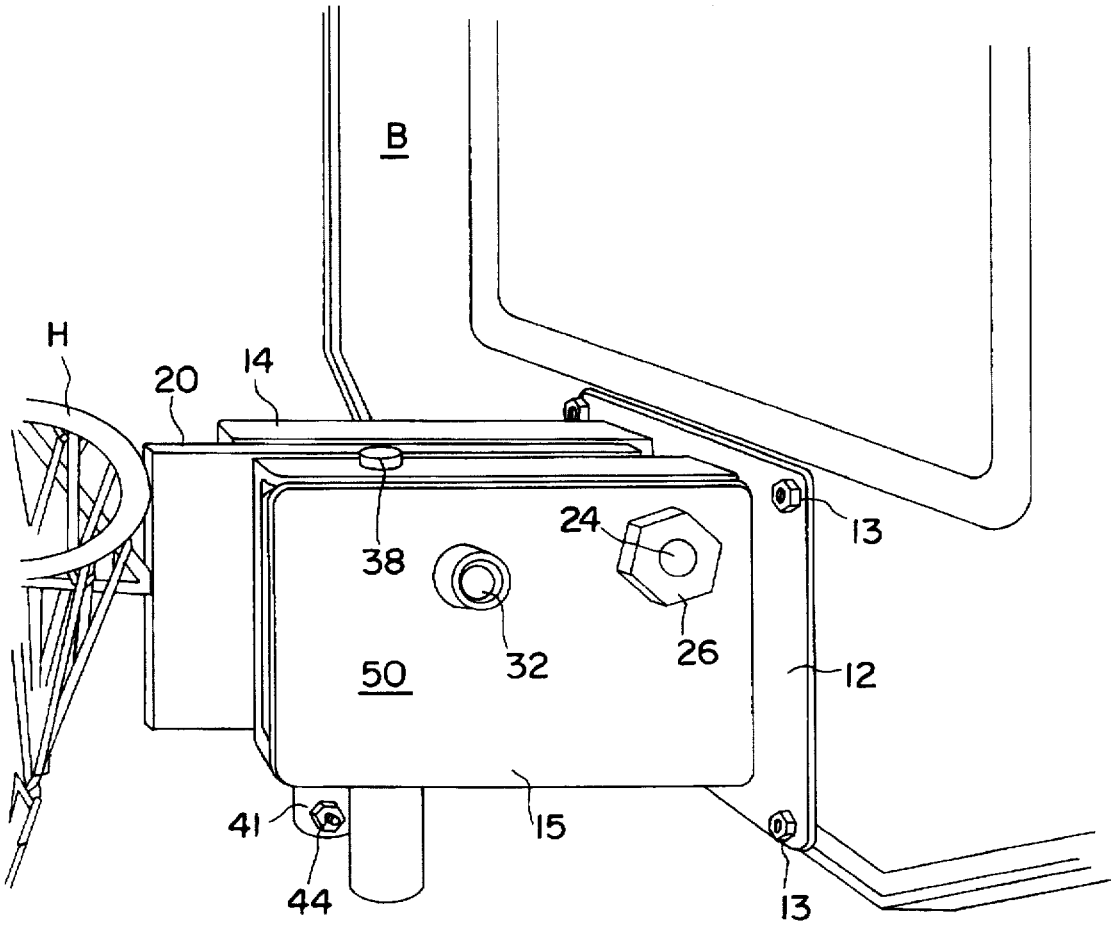
FIG. 2 is a perspective view of the basketball rim assembly according to the present invention with the hoop assembly in the play position.

Referring now to the drawings and particularly to FIG. 1, the locking basketball assembly is there illustrated. A backboard B is supported by a metal frame F. The backboard B also supports the basketball rim assembly generally indicated at 10 to which the actual basketball hoop H is connected. A user is shown gripping the rim positioning tool 90 and employing it to move the hoop between the play and out-of-play positions.

Figure 5:
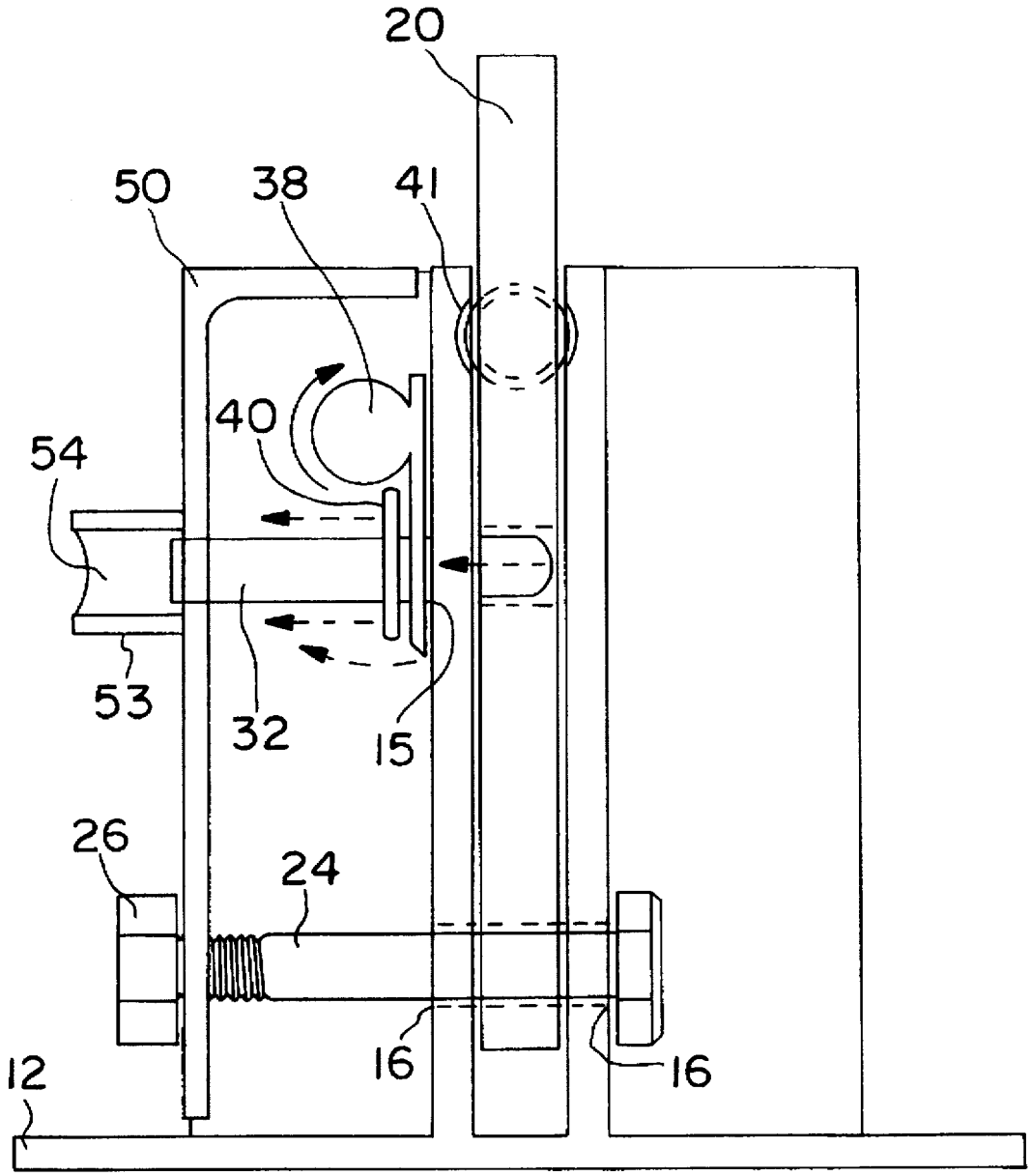
FIG. 5 is a plan view partially broken away of the basketball rim assembly according to the present invention.

Referring now to the remaining figures the basketball rim assembly 10 is shown in detail. The assembly 10 is fabricated from any material that is structural, such as iron and includes a base member 12 that is adapted to be connected to the backboard B by suitable means such as a nut and bolt (best shown in FIG. 1). A pair of arm members 14, 15 are connected to the base member 12 by suitable means, such as welding and extend perpendicularly outward from the plane of the backboard. The base member 12 takes the form of a flat rectangular piece of iron having openings 13 proximate each corner for receiving mounting screws (not shown). The arm members 14, 15 are U-shaped lengths of iron that are welded to the base member with the opposing flat surfaces facing each other and defining a space or channel extending therebetween. The arm members 14, 15 each include a first pivot opening or bore 16. A second horizontal opening or bore 18 extends through the central portion of arm member 15 and a pair opposing openings 18 are located in the opposite sides of arm member 15. In addition, a hollow cylindrical sleeve 41 spans the space between arm members 14, 15 and extends downwardly therefrom. A spring 42 is mounted therein (best illustrated in FIG. 5) and its position is maintained by screw 44 that spans the sleeve at its lower end. A bore 46 in each of the arm members 14, 15 permits the spring to extend upward into each of said arms 14, 15. The spring constant is chosen so that the spring exerts sufficient force on a rim support member 20 (to be described) to lift it to a position intermediate of the play and out-of-play positions.

The rim support member 20 has opposing ends, one of which is pivotally connected between arm members 14, 15 and the opposite end supports the hoop H. The hoop H is connected by suitable means such as welding. The rim support member 20 is movable from a first position wherein the hoop is positioned for ball play (hoop is parallel to the ground) to a second out-of-play or storage position (hoop is elevated and ball cannot pass through the hoop). The rim support member 20 is an elongate thin piece of iron or other suitable material and has a hole 22 located at one end which is adapted to receive a bolt 24 which is the pivot point about which the rim support member pivots. The bolt 24 passes through openings 16 and the rim support member thus allowing it to pivot. The other end of the bolt is threaded to receive a nut 26. In addition, the rim support member 20 includes two additional openings 27, 28 that serve to lock the hoop in the play and out-of-play positions, respectively.

A lock means or lock 30 is operatively associated with the base member for locking the rim support member in either the play position or the out-of-play position. The lock 30 comprises a pin 32 mounted on arm member 15 for movement into and out of openings 27, 28 in the rim support member to lock the rim support member in either the play or out-of-play positions. The pin 32 comprises an elongate shaft having an annulus 38 connected about the central portion thereof. The annulus 38 defines respective upper and lower portions of the pin. The upper portion mounts a helical spring 39 and the lower portion is adapted for movement into and out of openings 27, 28.

Means 34 for disengaging the pin from openings 27, 28 comprises a shaft 36 mounted for rotation on arm 15. At one end the shaft 36 mounts an annulus 38 that retains the shaft in its position on the arm and at its opposite end the shaft is shaped so as to form the male portion of a type of lock mechanism. The lock mechanism can take various shapes such as triangular, cross, semi-circular, etc. A U-shaped bracket 40 defining a channel is connected to the central portion of the shaft 36 and extends outwardly therefrom so that the pin 32 rests within the channel. The lock mechanism is positioned within a sleeve 16 which assists in locating the key 96 thereon.

A metal plate 50 covers the arm member 15 and is attached thereto by bolt 24 which also mounts the rim support member 20. The cover 50 is generally a square piece of metal having an L-shaped projection 52 that covers the side of the side of arm member 15. The plate 50 serves to protect the underlying lock mechanism. Plate 50 also includes a sleeve 53 having an opening 54 in which pin 32 is mounted for rotation.

Figure 3:
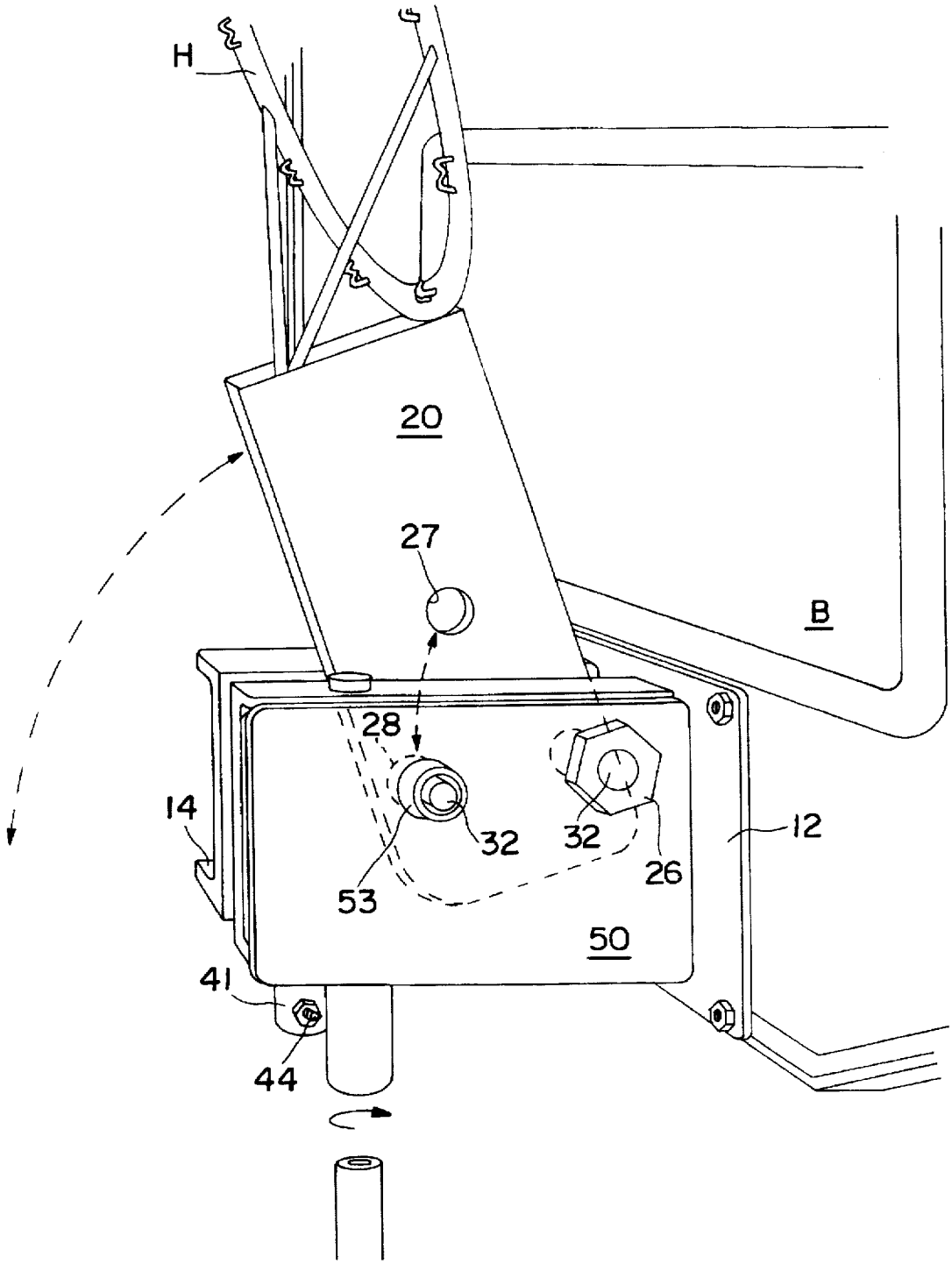
FIG. 3 is perspective view of the basketball rim assembly according to the present invention with the hoop assembly being unlocked with the key and moving between the play and out-of-play positions.
Figure 4:
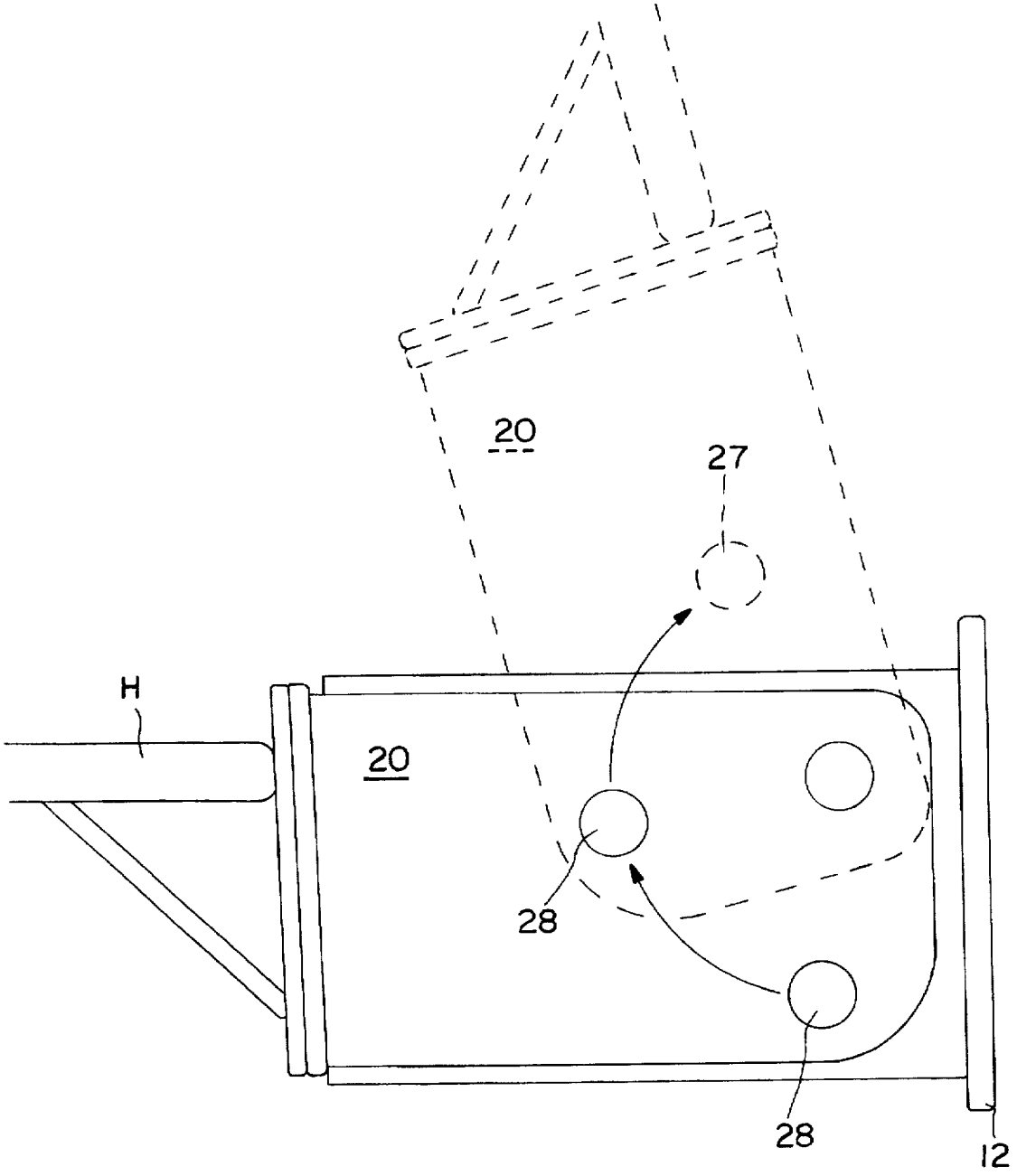
FIG. 4 is a side view of the basketball rim assembly according to the present invention and illustrating the locator holes for maintaining the rim support member in either the play or out-of-play positions.
Figure 6:
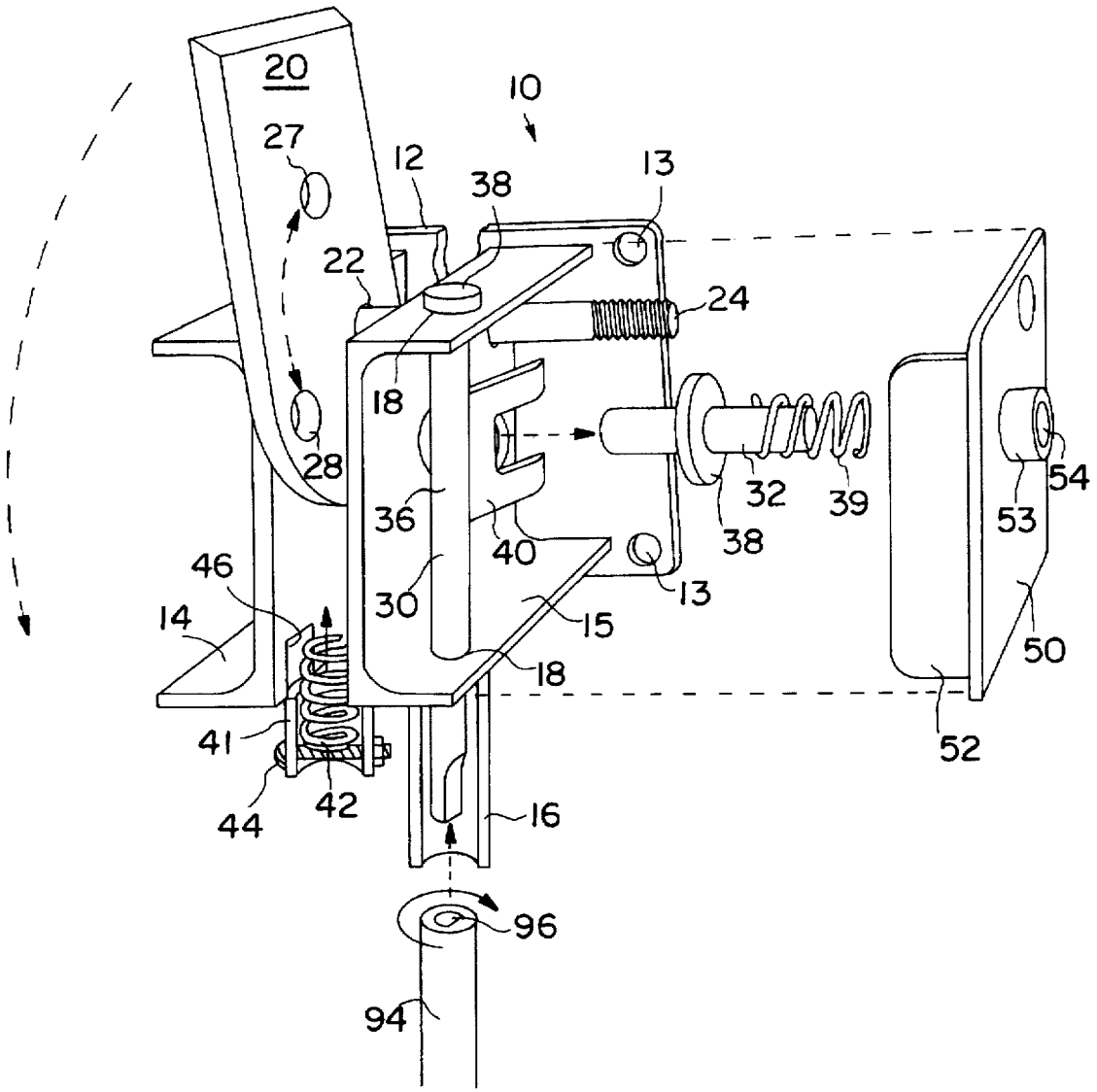
FIG. 6 is an exploded view, taken in perspective of the basketball rim assembly according to the present invention.

A rim positioning tool 90 comprises an elongate shaft having a proximal end 92 adapted to be gripped by the user and a distal end 94 having a key means or key 96 operatively associated therewith. The key 96 comprises an out of round female bore and is adapted to matingly cooperate with the lock 30 (best shown in FIGS. 3 and 6). A positioning arm 98 is operatively associated with the distal end 94 of the shaft and extends outwardly therefrom for moving the rim support member between the play and out-of-play positions.

In order to install the basketball rim assembly 10 on the backboard B, bolts are inserted through openings 13 and corresponding openings in the backboard and nuts are threaded thereon.

In operation, the user grips the rim positioning tool 90 at the proximal end 92 and inserts the key portion 96 over the lower end of shaft 36 and then rotates the same approximately ¼ (one forth) turn. This causes the bracket 40 to engage annulus 38, compressing spring 39 and lifting pin 32 out of opening 27. Spring 42 then exerts upward pressure on rim support member 20 which causes it to pivot upward so that when the shaft is removed from key 96, spring 39 biases pin 32 into contact with the side of rim support member 20. The positioning arm 98 is then employed to push the rim support member 20 upward until opening 28 aligns with pin 32 which becomes inserted therein by the force of spring 39. The rim support member is then locked in the out-of-play position. The same procedure is repeated in order to move the rim support member from the out-of-play to the play position except that the rim support member is pulled down until pin 32 is inserted into opening 27 thereby locking the rim support member 20 in place.

The foregoing embodiments and examples are to be considered illustrative, rather than restrictive of the invention, and those modifications which come within the meaning and range of equivalence of the claims are to be included therein.

That which is claimed is:

1. A basketball rim assembly for use in mounting a basketball hoop to a basketball backboard comprising:

a base member adapted to be connected to a basketball backboard, a rim support member having opposing ends, one of said ends being pivotally connected to said base member and the opposite end being adapted to mount a basketball hoop, said rim support member being movable from a first position wherein the rim is positioned for ball play to a second out-of-play position wherein the rim is positioned so that basketball cannot be played, and a lock means operatively associated with said base member for locking said rim support member in either the play position or the out-of-play position, and further wherein said lock means is adapted to cooperate with a key that unlocks said lock and permits the rim support member to be moved between the respective play and out-of-play positions.

2. The basketball rim assembly according to claim 1 further including a spring means supported by said base member positioned in cooperating relation with said rim support member for biasing said rim assembly to a position intermediate of the respective play and out-of-play positions.

3. A basketball rim assembly for use in mounting a basketball hoop to a basketball backboard comprising:

a base member comprising a mounting plate adapted to be connected to a basketball backboard and a pair of spaced apart arm members connected to said mounting plate and extending outwardly from the plane of the backboard;

a rim support member having opposing ends pivotally connected at one end between said arm members and where the opposite end is adapted to mount a basketball rim, said rim support member being movable from a first position wherein the rim is positioned for ball play to a second out-of-play position wherein the rim is positioned so that basketball cannot be played, a lock means operatively associated with said base member for locking said rim support member in either the play position or the out-of-play position, and further wherein said lock means is adapted to cooperate with a key that unlocks said lock means and permits the rim support member to be moved between the respective play and out-of-play positions.

4. The basketball rim assembly according to claim 3 wherein said rim support member includes a pair of spaced openings for maintaining the rim support member in either of the respective play and out-of-play positions and wherein said lock means comprises:

a pin mounted on one of said arm members for movement into and out of one of said openings in said rim support member upon actuation by the key to lock said rim support member in either the play or out-of-play position;

means for moving said pin out of one of said openings in order to move the rim support member between the play and out-of-play positions.

5. The basketball rim assembly according to claim 3 wherein said rim support member includes openings for maintaining the rim support member in the respective play and out-of-play positions and wherein said lock means comprises:

a pin connected to one of said arm members, said pin having an annulus about the central portion thereof, said annulus defining respective upper and lower portions of said pin, the upper portion of said pin mounting a spring and biasing said pin into one of said rim support openings and the lower portion being positioned for movement into and out of one of the openings in said rim support member, means for disengaging said pin from said opening comprising a shaft mounted for rotation on said one of said arm members, a bracket connected to said shaft and positioned in contacting relation with the lower portion of said pin, whereby rotation of said shaft causes the bracket to retract said pin out of said opening thereby permitting movement of the rim support member between the play and out-of-play positions.

6. The basketball rim assembly according to claim 5, further including means form maintaining said rim support member in a positions intermediated of said play and out-of-play positions.

7. The basketball rim assembly according to claim 6 wherein said means for maintaining said rim support member comprises a second spring mounted beneath said rim support member and biasing it upward.

* * * * *